United States Patent [19]

Hunter

[11] 4,007,570

[45] Feb. 15, 1977

[54] SUPPORT FOR NOGGING STRIPS IN WALL FRAMES

[75] Inventor: Richard Henry Hunter, Elanora Heights, Australia

[73] Assignee: Rondo Building Services Pty. Limited, Australia

[22] Filed: Feb. 18, 1975

[21] Appl. No.: 550,707

[30] Foreign Application Priority Data

Feb. 25, 1974 Australia ..... 6719/74

[52] U.S. Cl. ..... 52/317; 52/665; 52/726; 52/696

[51] Int. Cl.[2] ..... E04C 3/00

[58] Field of Search ..... 52/317, 665, 696, 721, 52/758 A, 760, 702, 751, 752; 248/57, 221, 201, 225, 223; 46/27, 28, 29; 108/109, 110; 211/182; 403/189, 190, 191, 168, 194, 199; 24/73 AP, 73 SA, 81 A, 81 AA, 81 CR, 81 AD, 83

[56] References Cited

UNITED STATES PATENTS

| | | | |
|---|---|---|---|
| 607,867 | 7/1898 | Marshall | 52/752 |
| 717,316 | 12/1902 | Avery | 52/751 |
| 1,054,175 | 2/1913 | Coffin | 52/751 |
| 1,105,851 | 8/1914 | Sherwood | 52/751 |
| 1,965,597 | 7/1934 | Koenig | 52/731 |
| 2,014,419 | 9/1935 | Voigt | 52/466 |
| 3,606,418 | 9/1971 | Buker | 52/726 |

*Primary Examiner*—J. Karl Bell
*Attorney, Agent, or Firm*—D. Paul Weaver

[57] ABSTRACT

A wall frame construction composed of sheet metal studs provided with a hole in at least one wall positioned at nogging level, nogging strips formable from offcuts of the studs slidable at right angles to the plane of the wall into pairs of nogging clips of U-shape provided with a swaged hole in each of their bases to form protruding collars for locating and retaining the nogging clips within said holes in the studs.

5 Claims, 6 Drawing Figures

SUPPORT FOR NOGGING STRIPS IN WALL FRAMES

This invention relates to the provision of nogging strips in wall frames, particularly frames of the prefabricated kind, and more particularly to means for supporting nogging strips within these frames.

In timber-framed walls one or more lines of nogging strips are provided either for reinforcement or additional backing to the covering panels, with each strip being composed of a length of timber bridging and nailed to adjacent studs. The application of nogging strips in this way to the frames is tedious and time-consuming. Greater difficulty is encountered in the attachment of such strips to wall frames comprising metal studs.

It is the main object of this invention to provide a support for nogging strips which will considerably simplify the attachment of nogging strips to wall frames, and which is nevertheless of simple form and inexpensive.

To this end, in one general form, the invention provides a support for a nogging strip between adjacent studs in a wall frame wherein confronting apertures are provided in said adjacent studs at nogging level, said support comprising a pair of nogging clips with each of said clips being of channeled U-shape to accommodate within its channel a respective end of said nogging strip and having a hole in its base, and a protruding collar formed by outwardly bending a marginal edge portion surrounding said hole in said base, whereby said collar when inserted into said aperture in a respective one of said studs provides a support for said end of the nogging strip.

Two preferred forms of the invention are illustrated in the accompanying drawings, in which.

Figure 1:
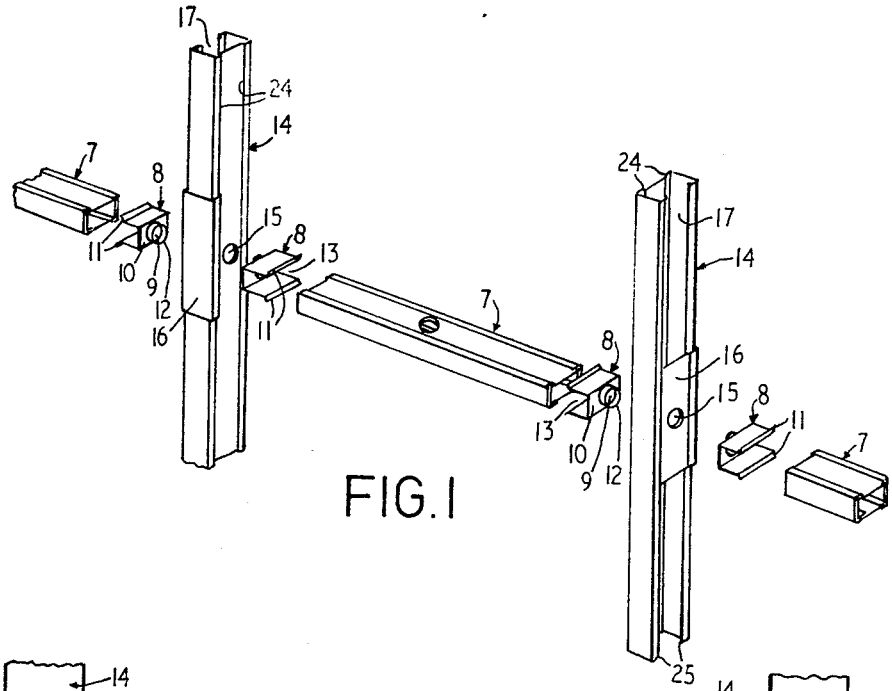
FIG. 1 is an exploded perspective view of two studs, nogging clips and one length of nogging according to a first form of the invention.
Figure 2:
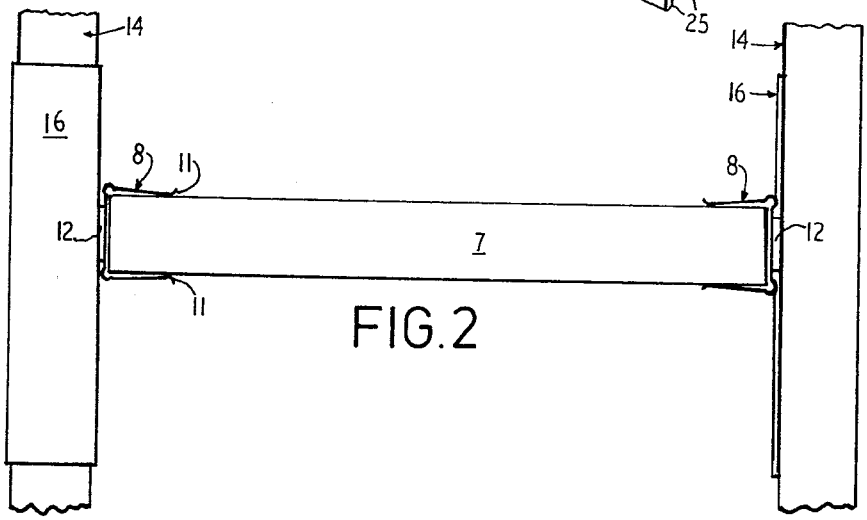
FIG. 2 is an elevation of a length of nogging and associated clips assembled between two studs.
Figure 3:
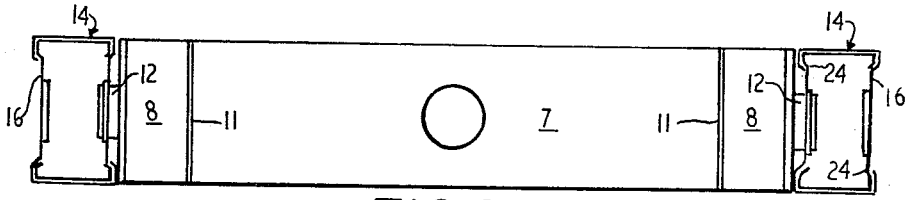
FIG. 3 is a plan view of the assembly shown in FIG. 2.
Figure 4:
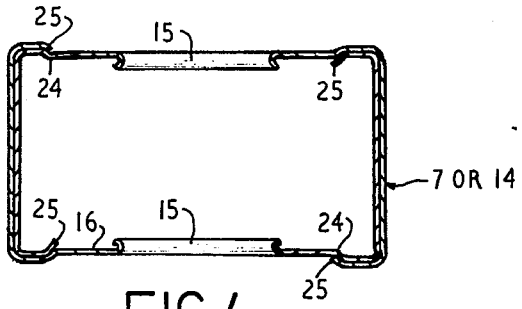
FIG. 4 is a cross-sectional view of either a stud or a nogging.

In a first preferred embodiment of the invention shown in FIGS. 1 to 4 the support for each nogging strip 7 consists of a pair of nogging clips 8 each being of channelled U-shape with a medial hole 9 in its base 10. These clips 8 may be speedily and easily formed by folding thin metal plates of, for e.g. galvanized iron. Preferably the arms of the clip 8 converge and their outer ends are outwardly flared as at 11. By swaging, or other means, a marginal edge portion of the hole 9 in the base 10 of the clip 8 is turned outwardly to form a protruding cylindrical collar 12 of short length. Such a clip 8 may be readily produced in a single or only a few pressing and folding operations. It is intended that the U-channel 13 in each clip 8 be dimensioned so as to accommodate snugly a respective end of a nogging strip 7. The nogging strip 7 may be of any material such as a length of timber or of metal box form as shown in the drawings.

Preferably, the nogging clips 8 of the invention are utilized in combination with metal studs of C-section and so formed with internal corner configurations 25 and corresponding return flanges 26 that individual pieces of a stud 14 may be interlocked to resemble a rectangular box form tube. Nogging strips 7 may be formed in this way from two pieces of stud material. If these pieces also contain holes in their walls a very convenient facility exists for accommodation of service lines and leads, such as power, water, etc., within the studs 17 or 22 and nogging strips 7 and extension of same through the wall frame.

Where a line of nogging strips is to be provided in a wall frame which comprises upright metal studs 14, confronting holes 15 will be provided at the nogging level in the confronting sides of an adjacent pair of metal studs 14. These holes 15 will require to be of a diameter capable of accepting, preferably as a press-fit, the cylindrical collars 12 of the nogging clips 8. If the outer end of the collar 12 is slightly flared, or is left with a raw edge, the clip 7 will be required to be forced into the hole 15 in the stud 14 and will be rotatably retained therein. Thus, the nogging clips 8 may be inserted as required and the nogging strips 7 slid in a plane at right angles to the plane of the wall frame, into position into the channelled portion 13 of the clips 8 at the workman's convenience. No skill whatsoever will be required of the workman in the application of the line of nogging strips 7. It will be noted that providing the nogging strips 7 are of the same width as the studs they need only be supported against vertical movement by the clips 8 but, preferably, the arms of the clips 8 enclose the nogging ends sufficiently snugly to restrain them from transverse movement with respect to the wall frame during normal handling of the latter in wall construction.

Where a stud 14 is of metal-box form the hole 15 at the nogging level will be provided in opposite sides of the stud but where a metal stud of channelled form is utilized a mounting hole 15 will be provided in the stud on one side while a short section 16 of the stud is attached to its channelled side 17 to form an intermediate boxed section, and is provided with the necessary mounting hole 15.

Figure 5:
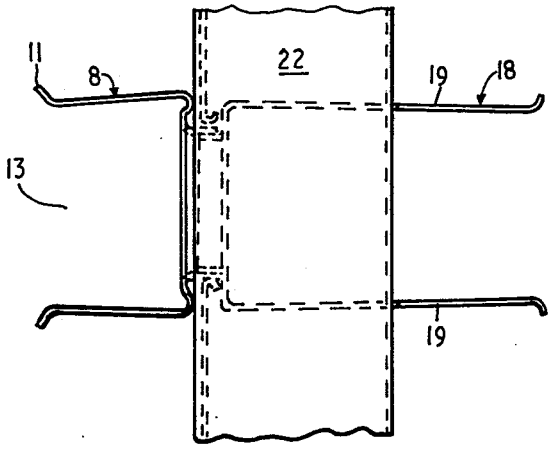
FIG. 5 is an elevation of a second form of the invention using a modified form of clip.
Figure 6:
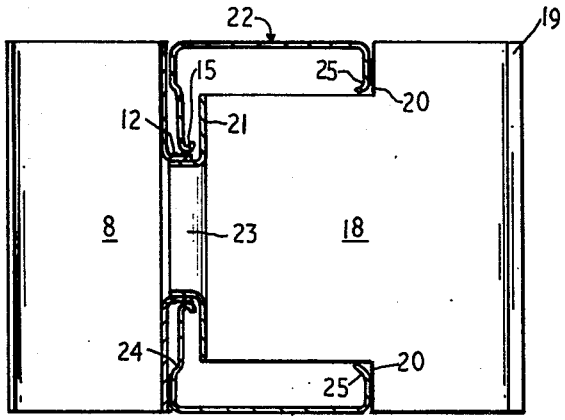
FIG. 6 is a plan view of the modified nogging clip shown in FIG. 5.

The short stud section 16 is dispensed with in a second form of the invention shown in FIGS. 5 and 6. In this case a modified form of clip 18 is used. This clip 18 is provided with elongated arms 19 which are stepped as at 20 so that the base 21 of the clip 18 can enter within the interior of a simple channel stud 22. The clip base 21 is provided with a protruding cylindrical collar 23. A clip 8 of the type already described is pushed into a hole 15 in the stud 22. The collar 23 of the modified clip 18 is a push fit in the bore of the collar 12 of the clip 8 so that the said clip can be anchored thereby within the stud 22 as shown in FIGS. 5 and 6. A stud similar to that shown in FIGS. 1 to 3 may then be slid by its end portion into the channel of the clip 18 so that its end abuts the return flanges 25 of the stud 22.

Important advantages of this form of wall construction are that the studs 14, or 22, may be cut to length and connected with suitable upper and lower plates (not shown) or temporarily supported, and subsequently nogging clips 8, or 18, as well as complementary stud sections 16, may be applied and then, without disturbance to the studs, nogging strips 7 may be added laterally to complete the frame. These strips may utilize scrap material and off-cuts from the studs 14, or 22.

The nogging strip support of the invention may also be applied to the studs of a timber wall frame by providing suitably dimensioned cylindrical recesses in the confronting faces of the timber studs, to which the nogging clips 8 may be attached.

Whereas two single embodiments have now been described in the foregoing passages it should be understood that other forms are possible within the scope of this invention.

What I claim is:

1. A wall frame comprising at least one pair of spaced upright studs with each stud of said pair being provided with an aperture at nogging level, at least one pair of nogging clips with each clip of said pair being of substantially U form with a hole in the base of the clip and an outwardly protruding collar surrounding said hole, each of said nogging clips of said pair having said protruding collar located within said aperture of a respective one of said studs, and a nogging strip supported between said pair of studs with its opposite end portions located between the arms of respective ones of said pair of nogging clips, said studs and nogging clips formed of folded sheet metal and each protruding collar formed by outwardly bending a marginal edge portion surrounding said hole, said studs being substantially C-shaped in cross section and having longitudinal formations facilitating interlocking two stud lengths in box form, said nogging strips provided in interlocked box form with a hole in one of their walls, certain of said nogging clips having elongated stepped arms extending through the open side of said C-shaped stud to the interior thereof, and the protruding collars on these nogging clips being of smaller size than the collars of other nogging clips and being telescopically engaged within the protruding collars of said other clips, the collars of said other clips being in turn received within said stud aperture.

2. A wall frame as defined in claim 1, and wherein the spaced arms of said U-shaped nogging clips are substantially horizontally disposed one above the other when engaged with the opposite ends of said nogging strip, said clip arms lying on the top and bottom faces of the nogging strip.

3. A wall frame as defined in claim 2, and wherein the arms of the U-shaped nogging clips are somewhat converging toward their free ends and are flared at their ends.

4. In a wall framing construction, at least a pair of spaced upright studs with each stud having a through aperture at nogging level, at least one opposing pair of nogging clips with each clip of said pair being substantially U-shaped and having an aperture formed through its base and an outwardly protruding collar secured to said base and surrounding said aperture of the base, said collar being sufficiently long axially and having a diameter in relation to the diameter of the stud through aperture to allow the collar to rest freely and separably within said through aperture and thereby form with the through aperture the entire support for said nogging clip on said stud, a nogging strip extending between said pair of studs and having opposite end portions engaged within said nogging clips and being supported thereby, said studs being of folded sheet metal and said nogging clips also formed of folded sheet metal with each said collar formed by outwardly bending a marginal edge portion surrounding said aperture of each nogging clip, said nogging strips having the same cross sectional shape as said studs, said studs being substantially C-shaped in cross section and being provided with longitudinal formations imparting to the studs box formations, said longitudinal formations having apertures in alignment with said through apertures of the studs at nogging level, whereby said protruding collars of said nogging clips may be engaged in the aligned apertures at the opposite sides of each stud for the support of the nogging strip.

5. In a wall framing construction as defined in claim 4, said U-shaped nogging clips having their spaced arms disposed generally horizontally one above the other when the clips are engaged with the nogging strip, said arms then lying on the top and bottom faces of the nogging strip.

* * * * *